US007262696B2

(12) United States Patent
Aota et al.

(10) Patent No.: US 7,262,696 B2
(45) Date of Patent: Aug. 28, 2007

(54) BUS MANAGEMENT SYSTEM

(75) Inventors: Shin Aota, Kanagawa (JP); Taku Himoto, Kanagawa (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 189 days.

(21) Appl. No.: 11/039,483

(22) Filed: Jan. 18, 2005

(65) Prior Publication Data

US 2005/0156759 A1 Jul. 21, 2005

(30) Foreign Application Priority Data

Jan. 21, 2004 (JP) ..... 2004-012726

(51) Int. Cl.
*G08B 1/08* (2006.01)

(52) U.S. Cl. ..... 340/539.11; 340/572.1; 340/433

(58) Field of Classification Search ..... 340/539.11, 340/573.1, 433, 572.1–572.9, 944; 235/376
See application file for complete search history.

(56) References Cited

U.S. PATENT DOCUMENTS 6,992,566 B2 * 1/2006 Striemer ..... 340/10.1
2004/0140899 A1 * 7/2004 Bouressa ..... 340/573.1
2006/0022796 A1 * 2/2006 Striemer ..... 340/7.2
2006/0164259 A1 * 7/2006 Winkler et al. ..... 340/944

FOREIGN PATENT DOCUMENTS

JP 05-256052 10/1993
JP 2002-288060 10/2002

* cited by examiner

*Primary Examiner*—Phung T. Nguyen
(74) *Attorney, Agent, or Firm*—Hogan & Hartson LLP

(57) ABSTRACT

A pick-up/drop-off management system improves the efficiency of carrying small children on a pick-up bus to a primary school or other facility. A non-contact method is used to read ID information of bus passengers, and to generate information regarding boarded passengers. When a person comes to meet a passenger, ID information of the meeting person is also read by using a non-contact method. The system is used to keep track of what passengers have boarded, and to control the meeting of passengers by others, by matching ID information for passengers and meeting persons held in memory, which can be accessed from a bus or a meeting location.

24 Claims, 16 Drawing Sheets

[ Fig. 1 ]
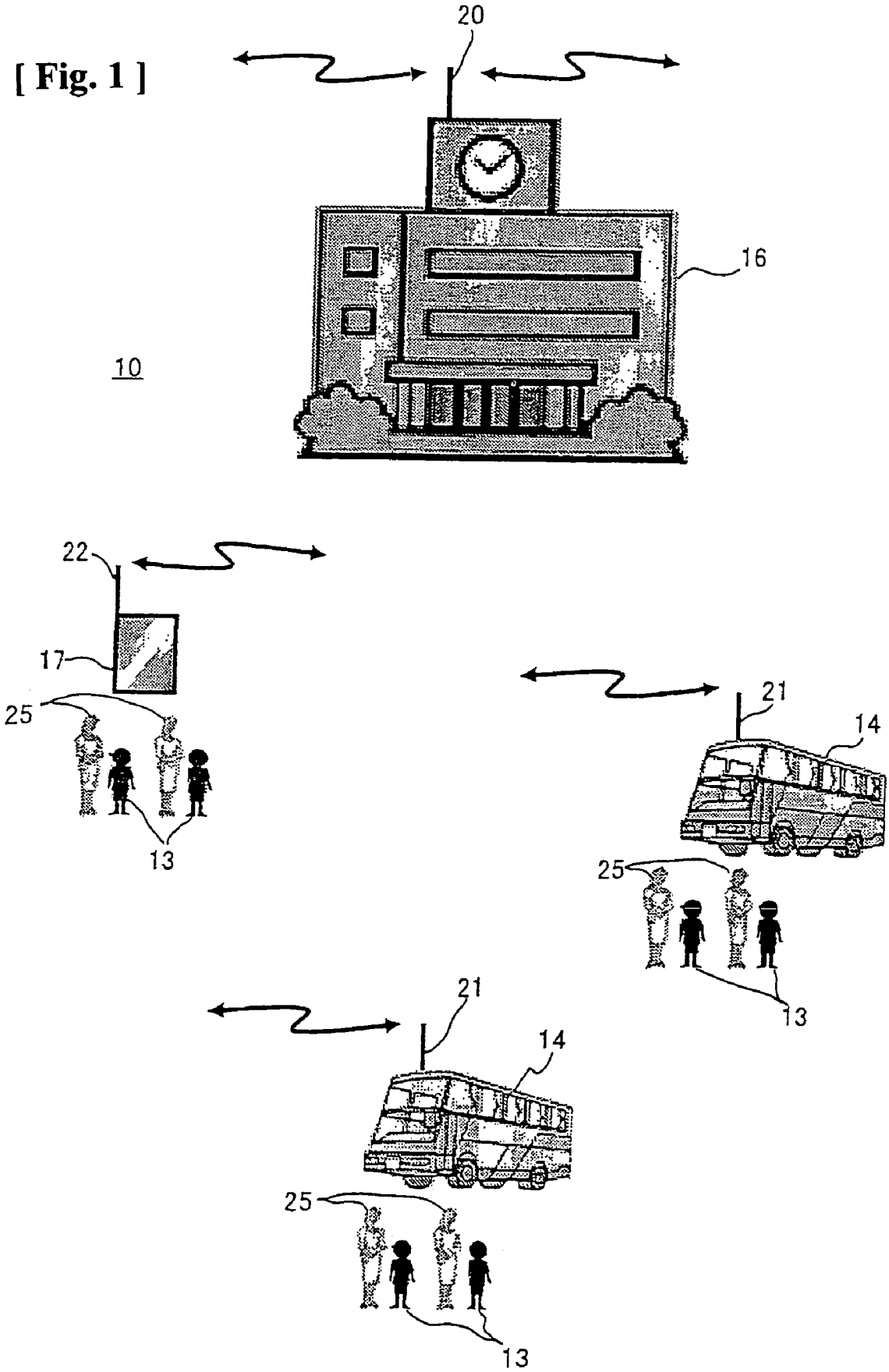

[ Fig. 2 ]
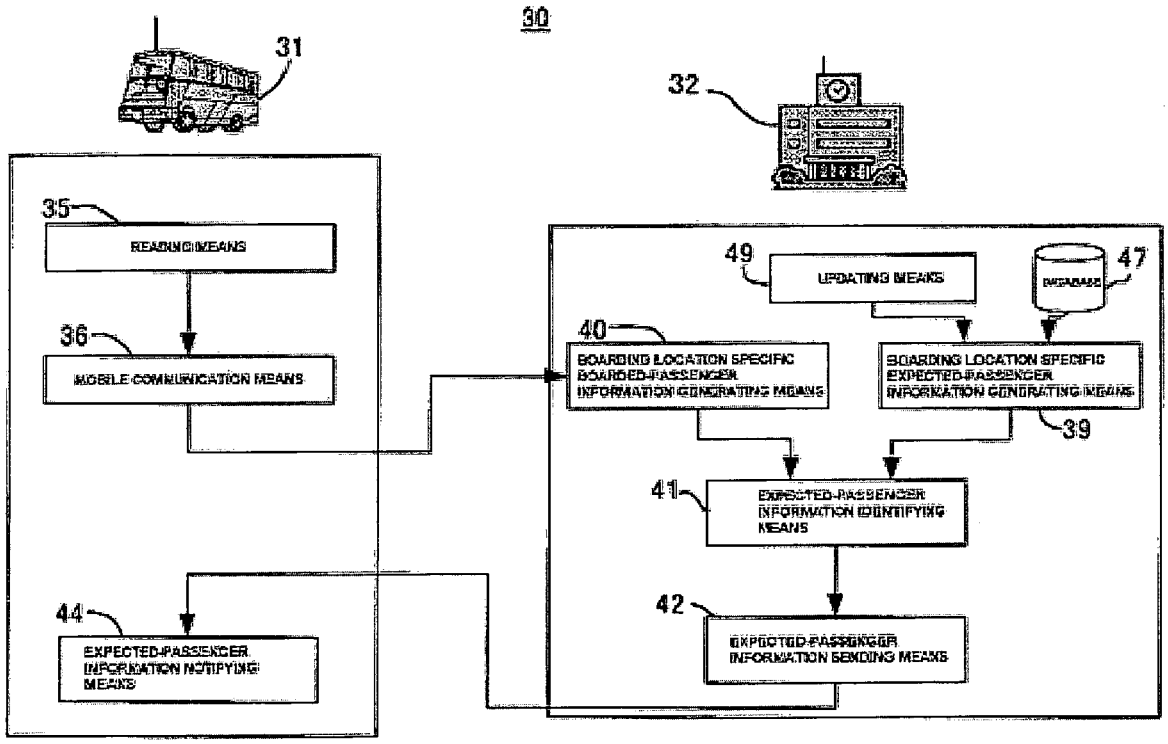

[ Fig. 3 ]
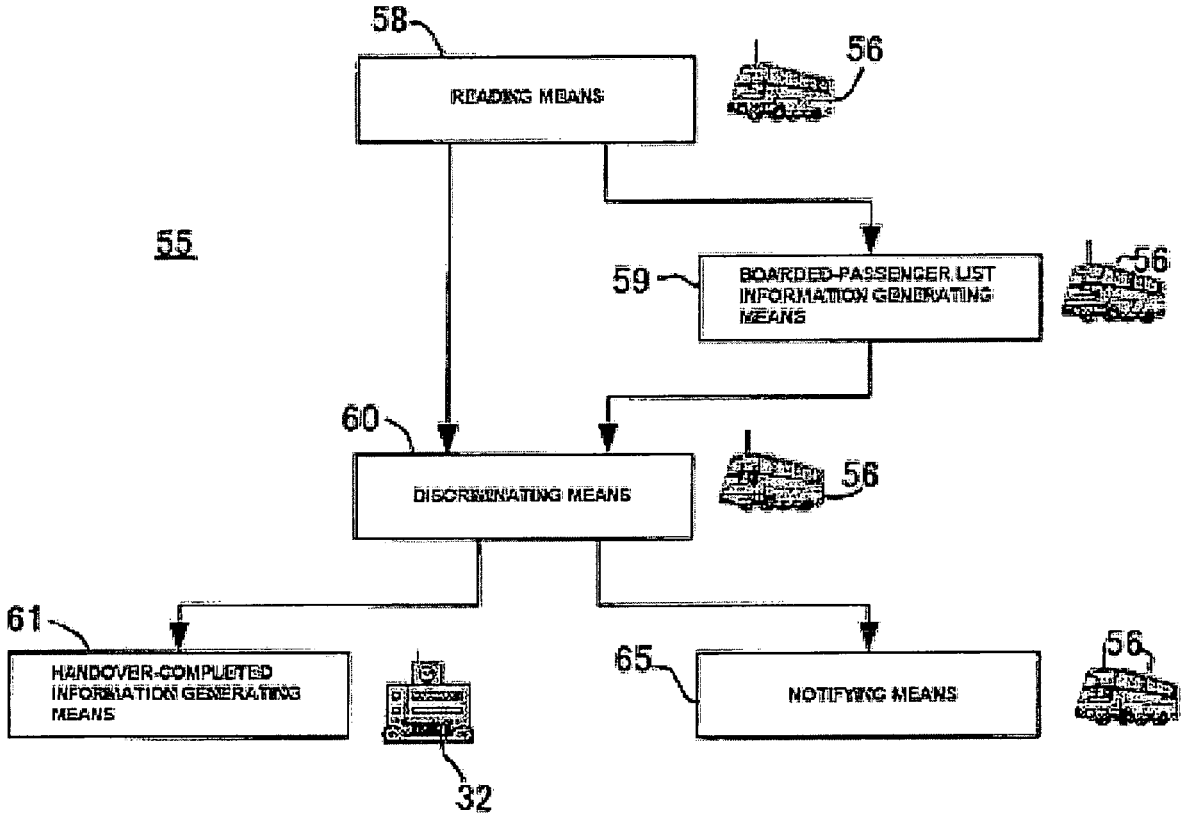

[ Fig. 4 ]
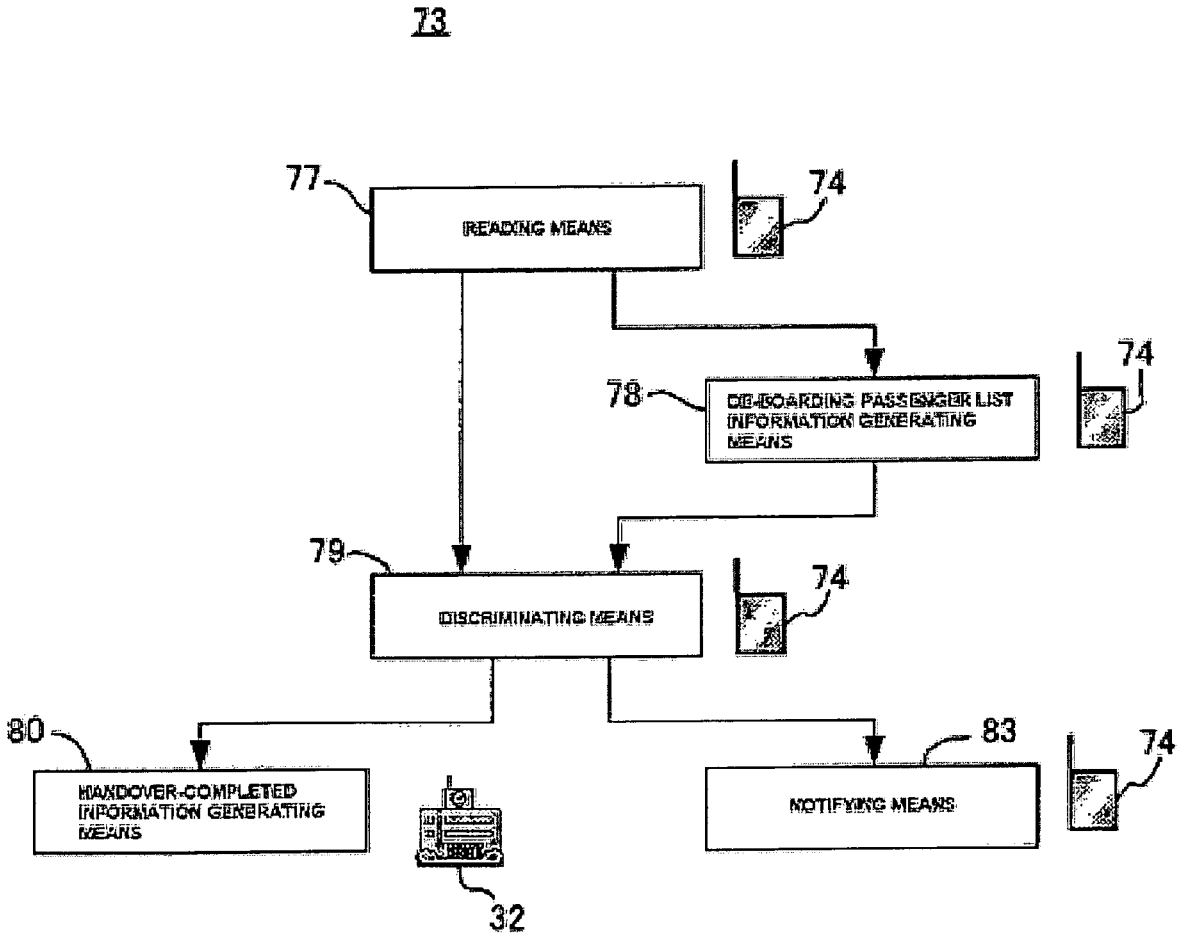

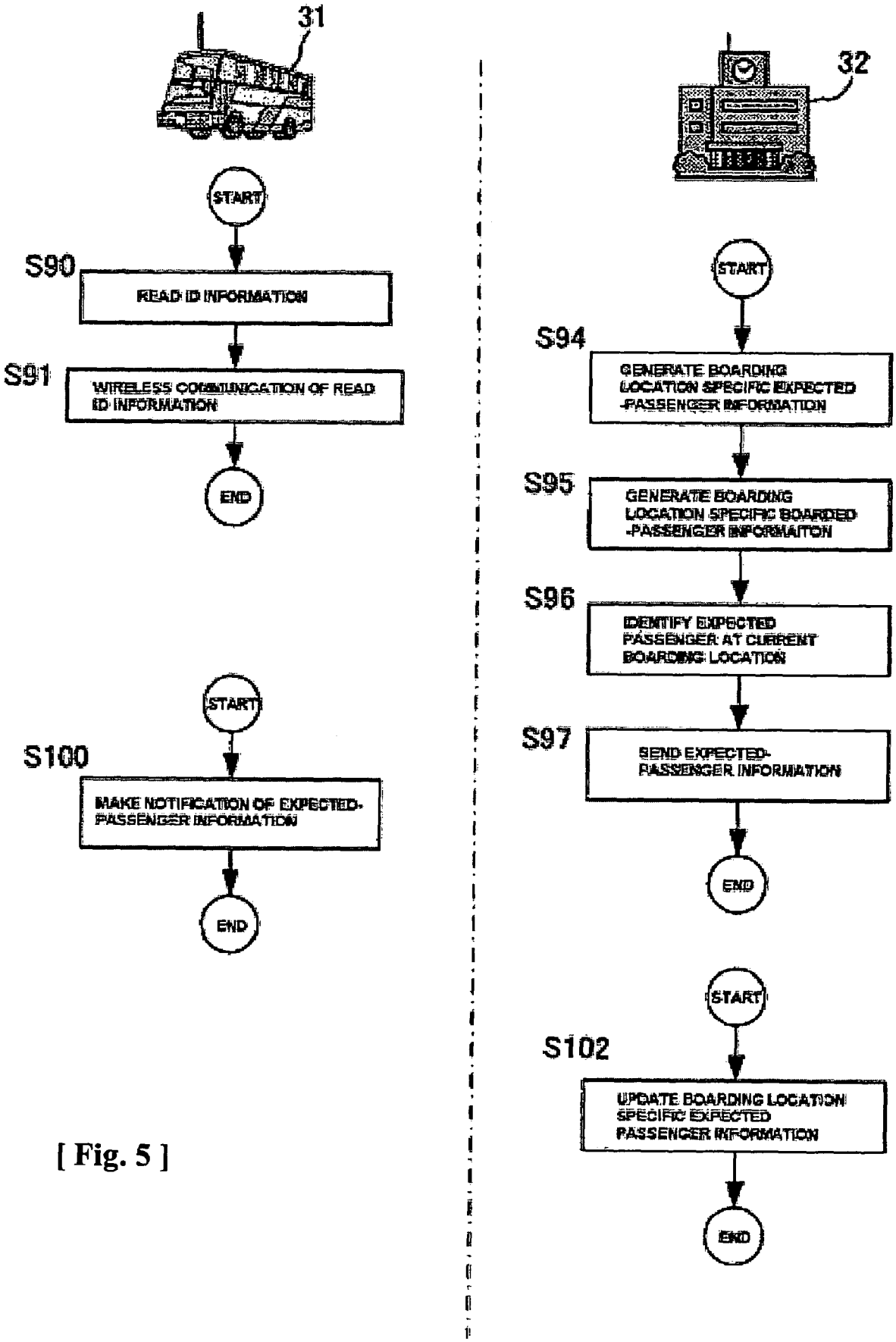
[ Fig. 5 ]

[ Fig. 6 ]
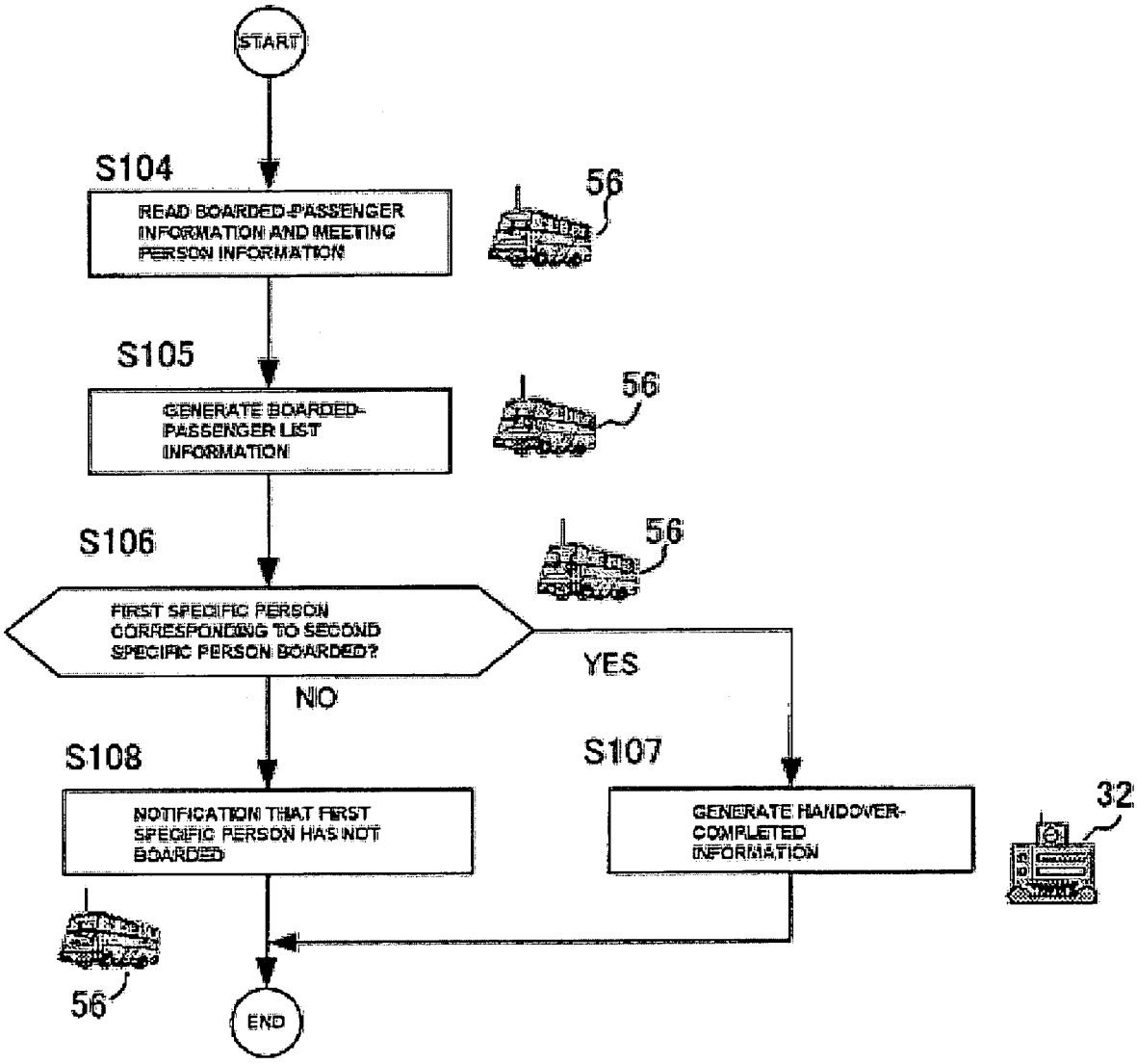

[ Fig. 7 ]
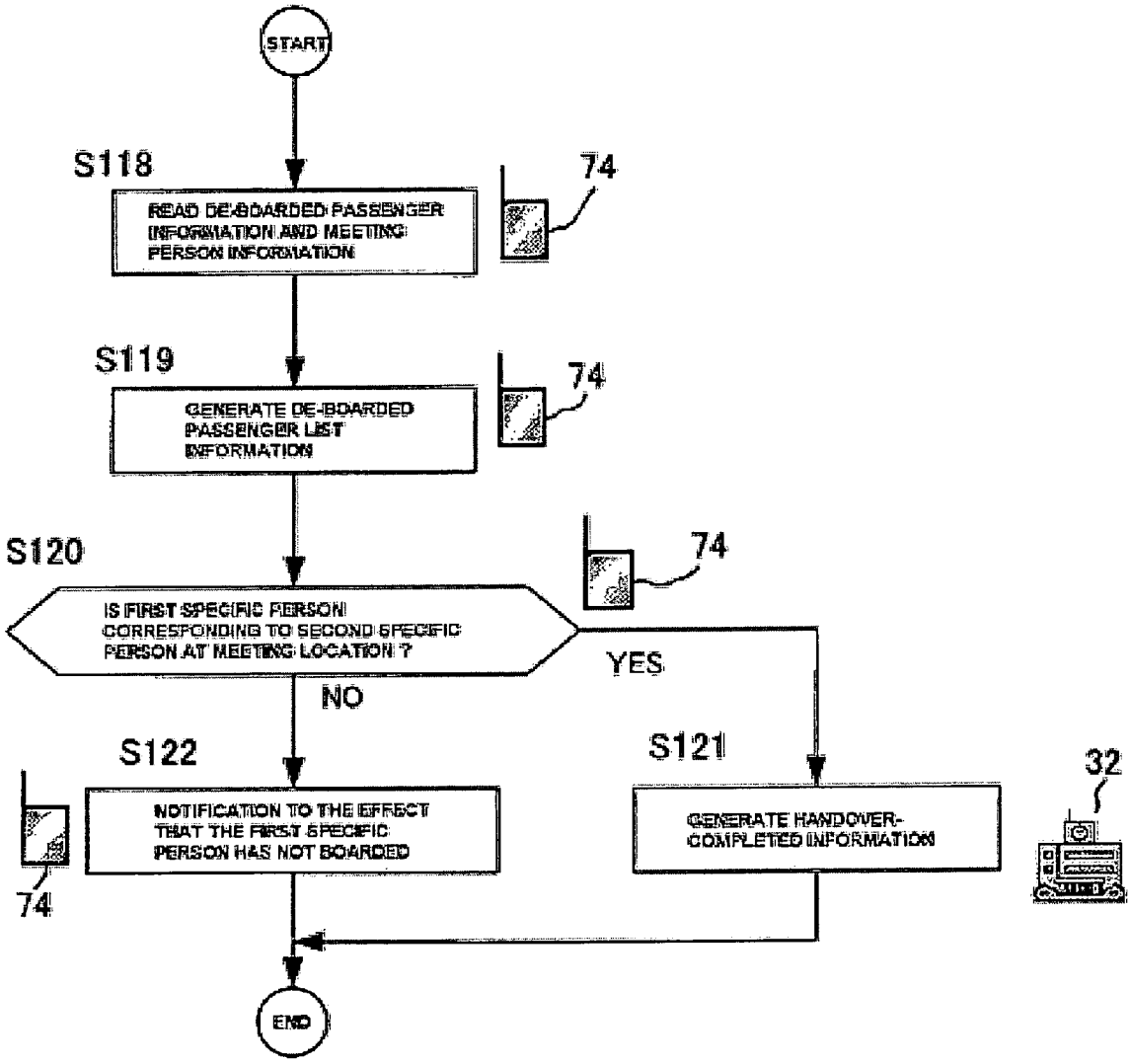

[ Fig. 8 ]
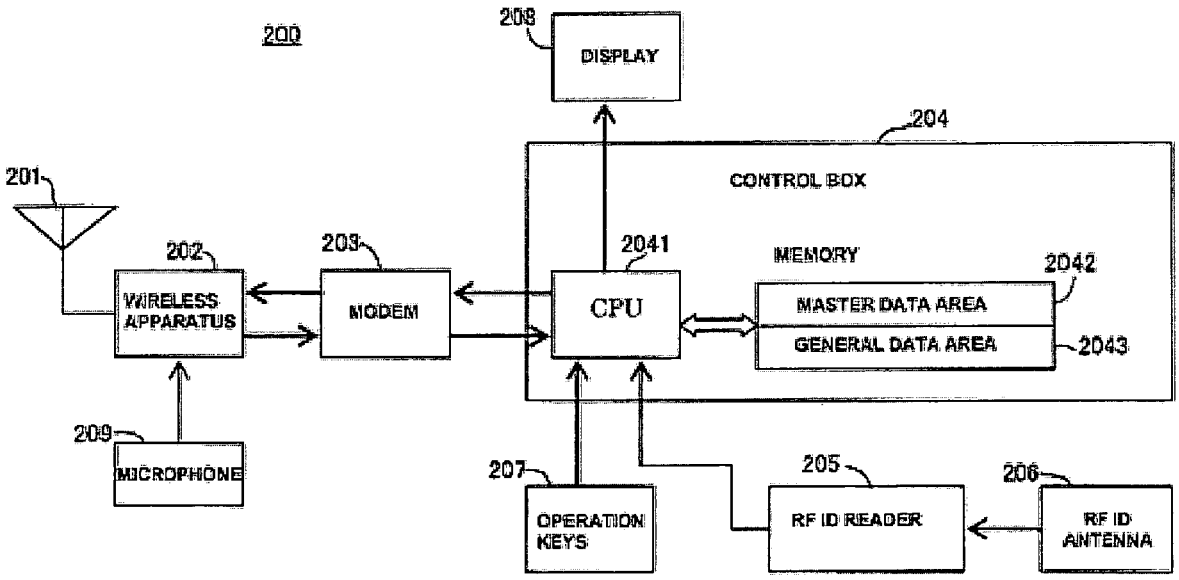

[ Fig. 9 ]
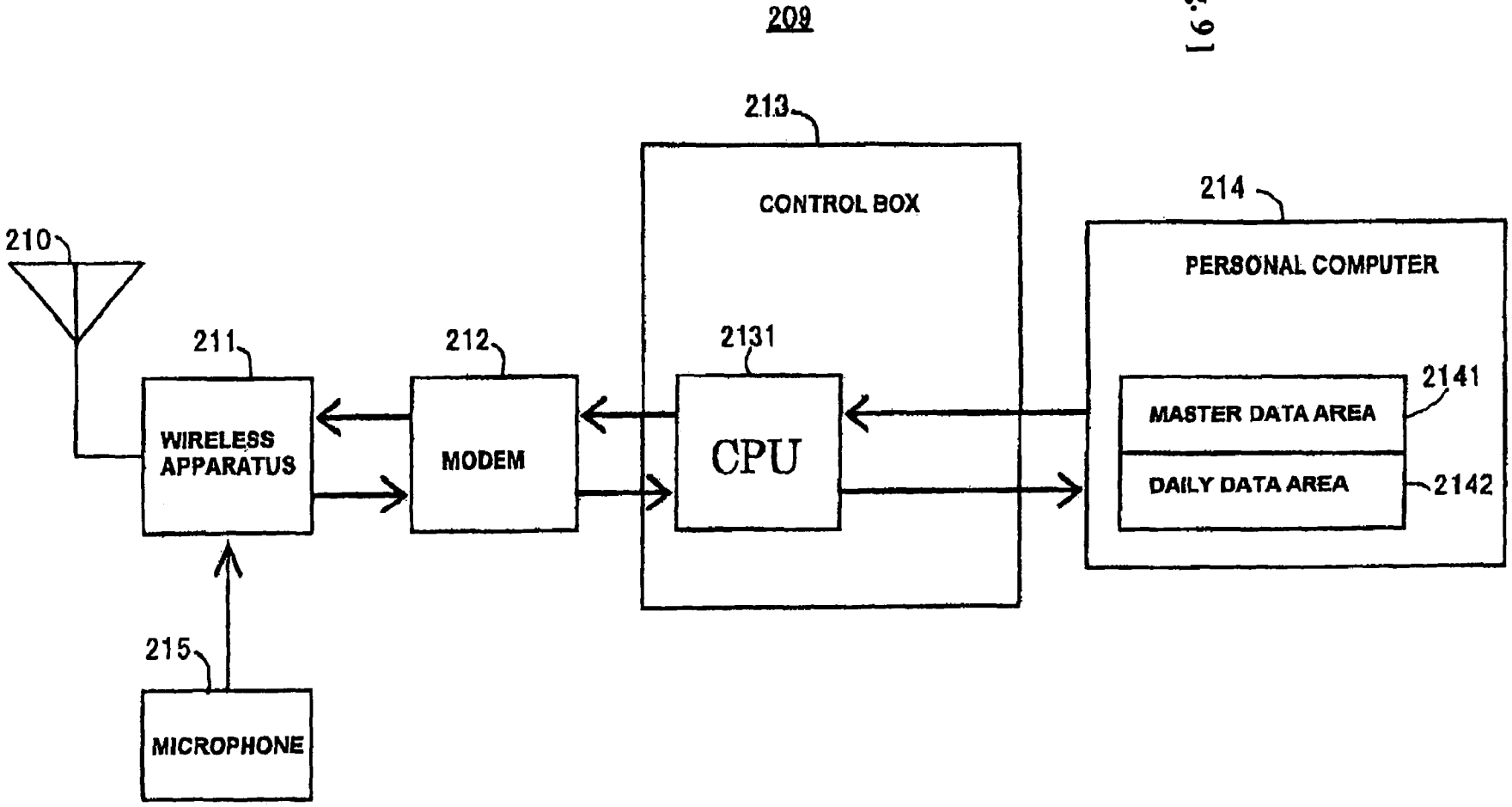

[ Fig. 10 ]
(a)
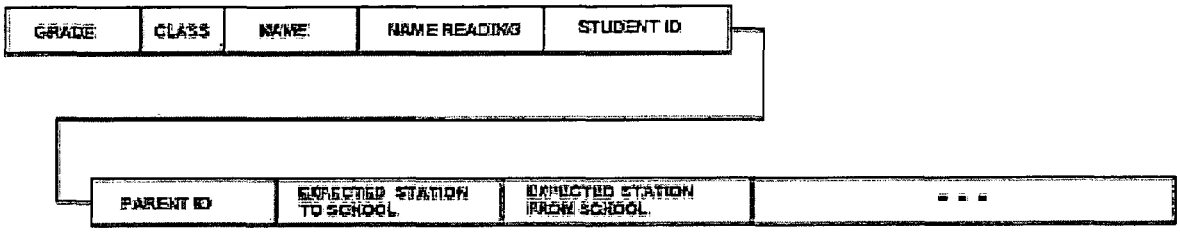
(b)
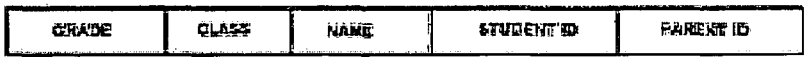

[ Fig. 11 ]
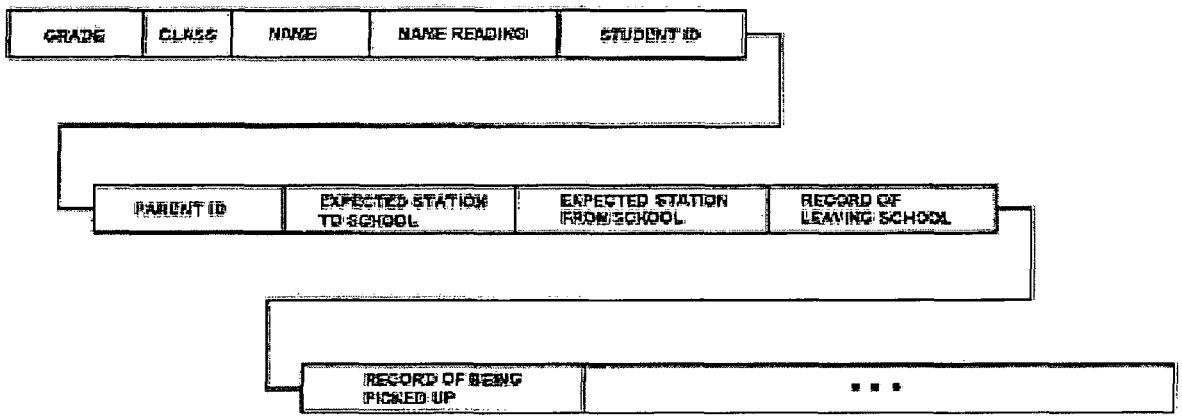

[ Fig. 12 ]
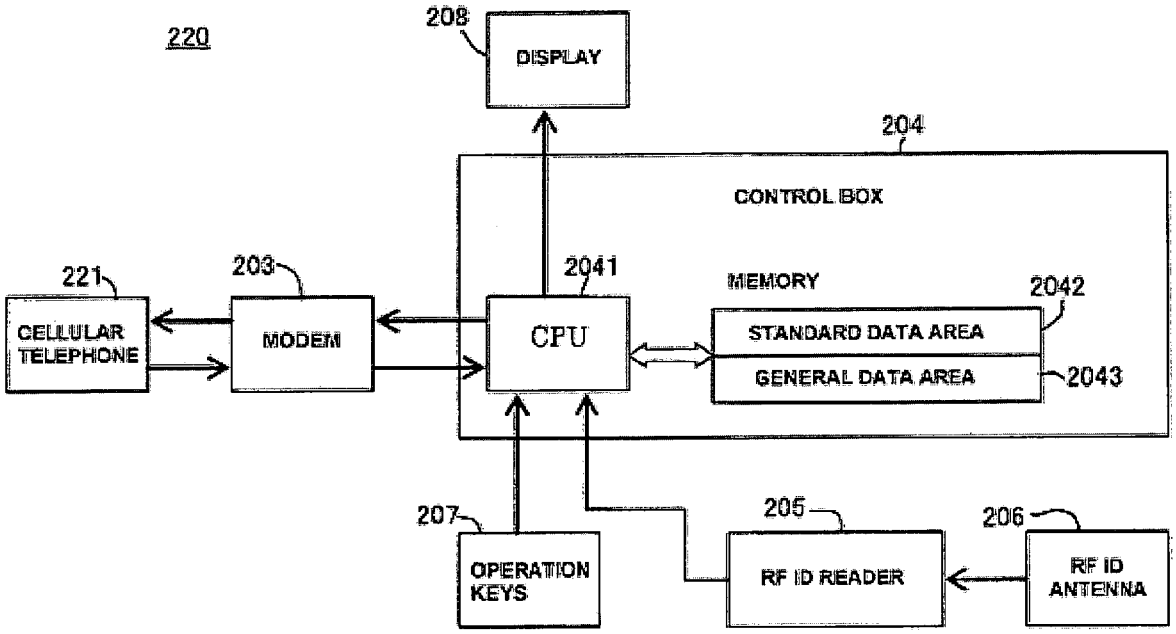

[ Fig. 13 ]
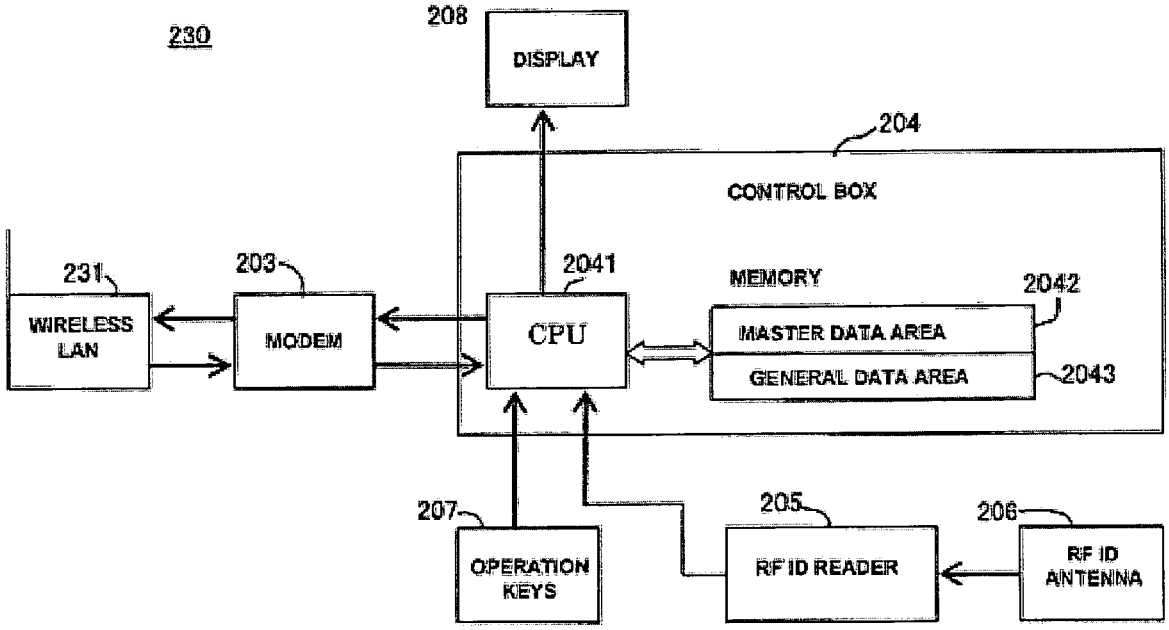

[ Fig. 14 ]
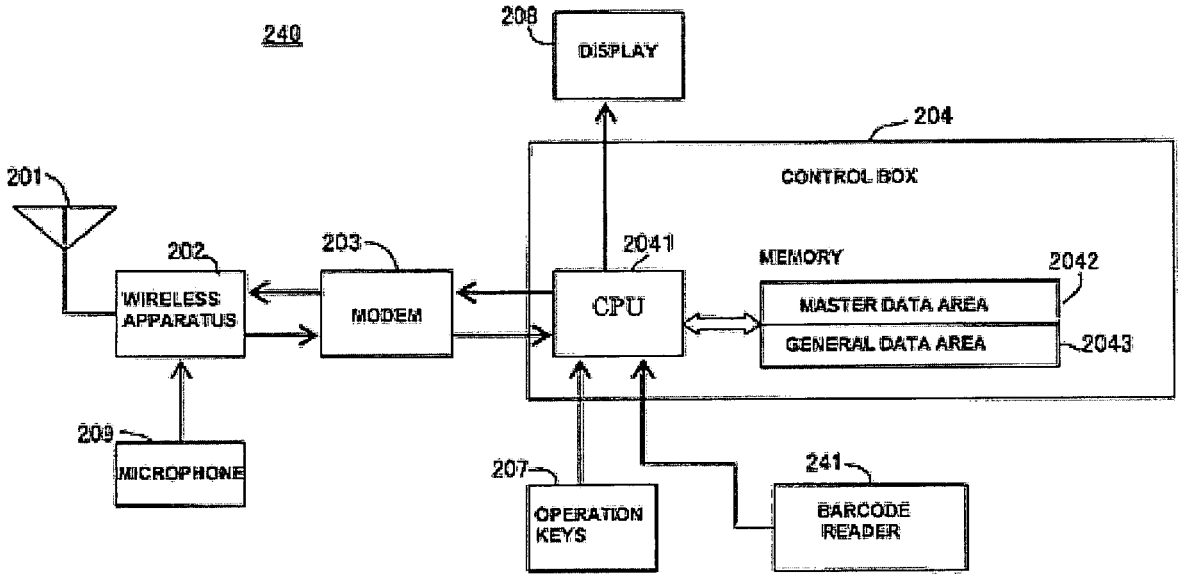

[ Fig. 15 ]
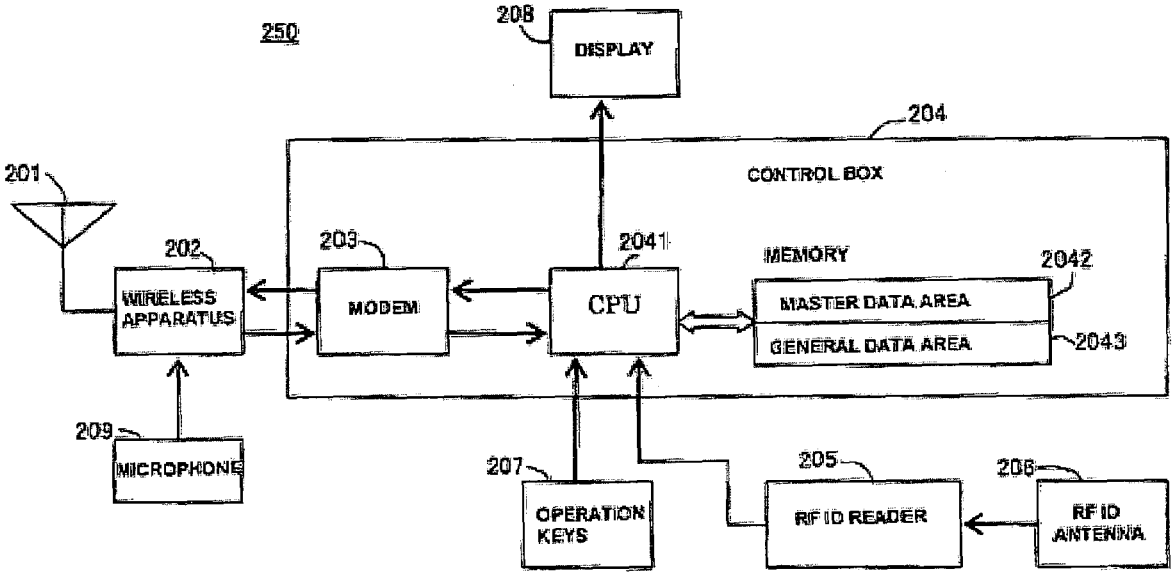

[ Fig. 16 ]
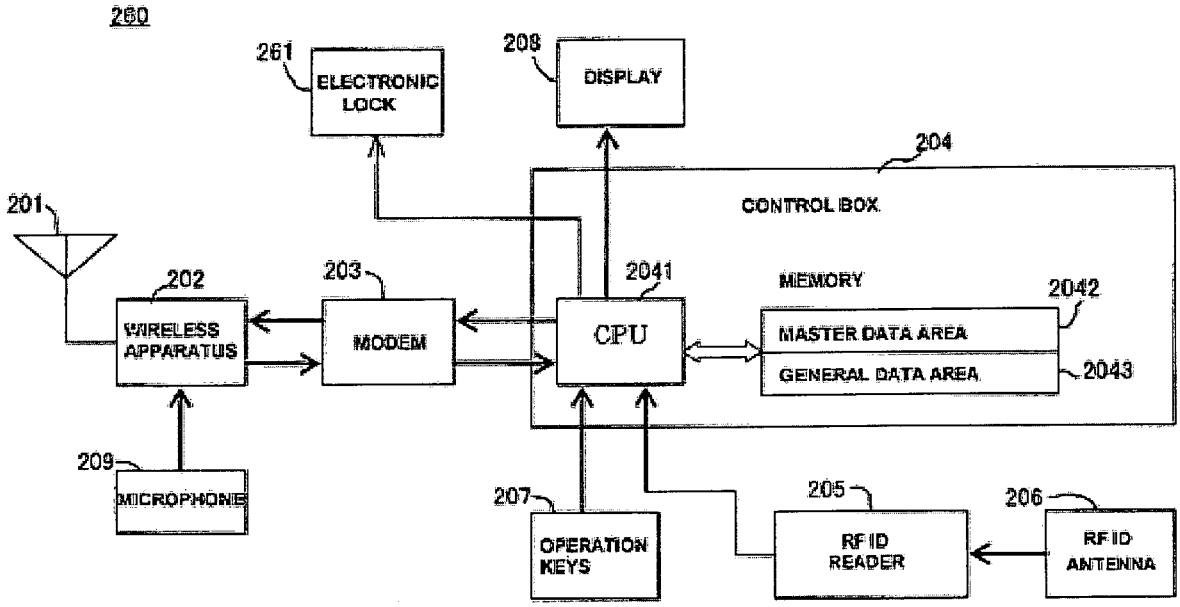

BUS MANAGEMENT SYSTEM

BACKGROUND OF THE INVENTION

1. Field of the Invention

The present invention relates to a pick-up bus management system that manages the picking up of small children using a pick-up bus, a drop-off bus management system, a pick-up and drop-off management system, a method for managing a pick-up bus, a method for managing a drop-off bus, and a method for managing pick-up and drop-off.

2. Related Background Art

In a conventional system, when a user inserts his or her IC card into a card reader at a shared terminal at a prescribed location, user-related information on the card is read, enabling use of a Web browsing service from the shared terminal.

In another conventional system, in which persons associated with entering and exiting, for example, a driving school or a nursery school, is given a non-contact type IC card to carry, and wherein, when each such person passes by a prescribed location, ID information of that person is read from the non-contact IC card, so as to manage the entry and exit of that person using a computer.

In order to provide convenience in commuting to school and provide for the safety of small children, it is necessary to provide pick-up buses and to have parents meet small children at a prescribed location. When picking up small children using a pick-up bus, there are cases in which a single or a number of pick-up buses make a number of trips in one day, cases in which a number of pick-up buses are making pick-ups simultaneously, and cases in which a pick-up bus handles a number of pick-up locations, making it extremely troublesome to keep track of whether the proper persons have been picked up and dropped off. Additionally, there being children who do not use the pick-up bus, if there are a number of different drop-off points, it is troublesome to manage whether or not a child has been safely handed over to his or her parent.

Although there is a disclosure of the management of entry and exit of children and employees, for example, into and out of a prescribed facility or room, there is no disclosure of a specific and effective management system for managing the actual use of a pick-up bus for pick-up, or of managing the handing over of small children to their parents at a de-boarding location.

Similarly, although there is a disclosure of the use of a non-contact type IC car carried by an associated person, a non-contact type IC card reader that reads information from the non-contact type IC card, and the management of exit and entry of the persons, the management of work status, the management of study history, and the management of the location of the person and the like, there is no disclosure of a specific and effective management system for managing the actual use of a pick-up bus for pick-up, or of managing the handing over of small children to their parents at a de-boarding location.

Accordingly, it is an advantage of the present invention to provide a pick-up bus management system and method, which are effective in using a pick-up bus to pick-up a number of persons at a prescribed location and bring them to a prescribed drop-off location.

Another advantage of the present invention is to provide a drop-off bus management system and method, which are effective in dropping off a plurality of persons from a prescribed origin location to a location at which persons having come to meet and to pick up the passengers.

Yet another advantage of the present invention is to provide a system and method that are effective in managing whether or not small children or the like have been reliably handed over to their parents, who have come to meet them at a prescribed location.

SUMMARY OF THE INVENTION

In a pick-up bus management system according to the present invention, each specific person is issued an ID information storage medium, in which is stored ID information regarding that specific person, and which the person can carry. The system performs processing with regard to the ID information storage medium.

This system has an ID information reader, which has the function, at the boarding point of the pick-up bus (hereinafter "current location"), of reading, from the ID information storage medium of a passenger who boards, the ID information related to that specific person, and a mobile communication system, which has the function of sending and receiving data via wireless communication with a prescribed information management location.

The information management location has a function of generating expected-passenger information separately for each specific boarding location, and a function of generating already-boarded specific person information for each boarding location, which generates this information for specific persons who have boarded at each boarding location, based on ID information and boarding location information received from the pick-up bus.

The system further has an expected-passenger identification function for identifying a person expected to board at the current location, based on a comparison of the boarding location-specific expected-passenger information and the boarding location specific already-boarded person information, and an expected-passenger information transmission function, which transmits information regarding the identified expected passenger as expected-passenger information.

The pick-up bus has an expected-passenger notification function for giving notification of an expected passenger at the current boarding location, based on expected-passenger information received from the information management location.

A drop-off bus management system according to the present invention performs processing of two ID information storage media, one issued to a first specific person who boards a bus, which stores information regarding that person, and another which is issued to a second specific person coming to meet the first specific person on the bus, which stores information regarding the second specific person meeting the first specific person on the bus.

This drop-off bus management system has a reader, which reads, as boarded-passenger information, the ID information of an ID information storage medium of the first specific person when the first specific person boards the drop-off bus at the origin point, and which reads, as meeting person information, the ID information of the ID information storage medium of the second specific person at the de-boarding location, which is the destination of the first specific person.

The drop-off bus management system also includes a boarded passenger list information generator, which has the function of generating a list of passengers who have boarded, a discriminator, which has the function of making a first and a second judgment in the cases, respectively, in which, based on the meeting person information and boarded passenger information, the first specific person corresponding to the second specific person has and has not boarded the drop-off bus, and a handover-completed information generator, which has the function of generating handover-completed information associated the first specific person, indicating that with the first specific person has been handed over to a corresponding second specific person.

A pick-up/drop-off management system according to the present invention performs processing of two ID information storage media, one carried by a first specific person who boards a bus, which stores information regarding that person, and another carried by a second specific person coming to meet the first specific person on the bus, which stores information regarding the second specific person meeting the first specific person on the bus.

This pick-up/drop-off management system has a reader, which reads, at a prescribed meeting location, from the portable ID information storage media of the first and second specific persons, ID information of the first specific person, who will de-board a bus, and ID information of the second specific person, who will meet the first specific person.

The system also includes a de-boarding passenger list information generator, which has the function of generating a list of passengers who de-board, based on the de-boarded passenger information, a discriminator, which has the function of making a first and a second judgment in cases, respectively, in which, based on the meeting person information and de-boarding passenger information, the first specific person corresponding to the second specific person is and is not present at the meeting location, and a handover-completed information generator, which has the function of generating handover-completed information associated the first specific person indicating that the first specific person has been handed over to the corresponding second specific person.

A method for managing a pick-up bus according to the present invention performs processing with regard to the portable information storage medium issued to each specific person, in which ID information of each specific person is stored. This method includes at the bus, a step of reading, from an ID information storage medium, ID information related to a specific passenger who boards the bus at a boarding point of the pick-up bus, which is the current location of the pick-up bus, a step of sending the read ID information by mobile wireless communication and at a prescribed information management location, a step of generating expected-passenger information separately for each boarding location.

The method also includes a step of generating, as specific person information for persons who have boarded, already-boarded specific person information for each boarding location, based on ID information and boarding location information received from the pick-up bus, a step of identifying specific persons who have not yet boarded at the current location, based on a comparison of the boarding location specific expected-passenger information for each boarding location and the already-boarded specific person information for each boarding location, a step of sending to the pick-up bus information regarding a specific person identified as having not yet boarded, and at the pick-up bus, a step of giving notification of a person who has not yet boarded at the current location, based on the information regarding a specific person who has not boarded received from the information management location.

A method for managing a drop-off bus according to the present invention performs processing of two ID information storage media, one issued to a first specific person who boards a bus, which stores information regarding that person, and another issued to a second specific person coming to meet the first specific person on the bus, which stores information regarding the second specific person meeting the first specific person on the bus.

This method for drop-off bus management includes a step of reading, as boarded-passenger information, the ID information of an ID information storage medium of the first specific person when the first specific person boards the drop-off bus at the origin point, and of reading, as meeting person information, the ID information of the ID information storage medium of the second specific person at the de-boarding location, which is the destination of the first specific person.

The method also includes a step of generating boarded passenger list information of persons who have boarded, a step of discriminating, whereby a first and a second judgment are made in the respective cases in which, based on the meeting person information and boarding passenger information, the first specific person corresponding to the second specific person is and is not riding on the drop-off bus, and a step of generating handover-completed information associated with a first specific person, which indicates that the first specific person has been handed over to the corresponding second specific person.

A method for pick-up/drop-off management according to the present invention performs processing of two ID information storage media, one issued to a first specific person who boards a bus, which stores information regarding that person, and another issued to a second specific person coming to meet the first specific person on the bus, which stores information regarding the second specific person meeting the first specific person on the bus.

This pick-up/drop-off management method includes a step of reading, at a prescribed meeting location, from the portable ID information storage media of the first and second specific persons, ID information of the first specific person, who will de-board a bus, and the ID information of the second specific person, who will meet the first specific person, a step of generating de-boarding passenger list information regarding passengers who de-board, based on the de-boarded passenger information, a step of discriminating, whereby a first and a second judgment are made in the respective cases in which, based on the meeting person information and de-boarding passenger information, the first specific person corresponding to the second specific person is and is not present at the meeting location, and a step of generating handover-completed information associated with the first specific person indicating that the first specific person has been handed over to the corresponding second specific person.

The ID information storage medium that can be carried by a specific person is, for example, an RF ID (radio frequency ID, otherwise know as an IC tag), or a non-contact type IC card. The reading of ID information from the ID information storage medium by the reader is typically a non-contact type of reading using a wireless method, although this can alternatively be a contact-type method. In the case of reading the ID information of the ID information storage medium by a wireless method, the specific person passes the ID information storage medium through a restricted location, or intentionally holds the ID information storage medium up in a prescribed direction. The RF ID is allowed to hang from, or affixed to, a object such as a bag, which is carried by the specific person. In this description, the term specific person or first specific person refers to, for example, a small child, such as a nursery school child, a primary school child, a student at a driving school, or an elderly person using a hospital or care facility. The second specific person refers to a person, for example, who is the parent or guardian of a small child or the relative of an elderly person.

The pick-up bus and drop-off bus is typically one and the same bus serving both functions, but can alternatively be separate buses. The information management location is typically a fixed location, but can alternatively be located aboard a mobile platform. The facility or group making use of the pick-up bus or drop-off bus can have, rather than a single bus, a plurality of pick-up buses and drop-off buses, can operate one and the same pick-up bus or drop-off bus through the same location at a number of different times, and can also have the bus stop at a plurality of locations on one pick-up round. The boarding location and the de-boarding location are, for example, positioned at train stations. The pick-up bus and the drop-off bus transmit not only ID information of specific persons, but also the boarding location and de-boarding location information to the information management location, using an appropriate wireless method, and can assist in performing management of each boarding location and de-boarding location. The communication path between the information management location and the pick-up bus or the drop-off bus need not be entirely wireless, and can alternatively be wireless communication from the pick-up bus or the drop-off bus up until an intermediate location, with the remainder of the path being hard-wired communication. Additionally, part of the communication path can include the Internet or a LAN.

The notification by a notification function and the notification by the notification step include visual display to a display apparatus and audible notification. The notification, addition to automatic notification, includes notification that is made by the driver or manager of the pick-up bus or the drop-off bus in response to a request for notification.

According to the pick-up bus management system and method of the present invention, it is possible for the driver of a pick-up bus to be aware of persons who have not boarded at a boarding location at the current point in time, thereby enabling efficient operation of the pick-up bus.

According to the drop-off bus management system and method of the present invention, it is possible to efficiently and quickly ascertain whether or not a first specific person, who was carried by the drop-off bus, has been met by a second specific person.

According to the pick-up/drop-off management system of the present invention, it is possible to efficiently and quickly ascertain whether or not a person about to de-board at a meeting location has been handed over to a second specific person.

BRIEF DESCRIPTION OF THE SEVERAL VIEWS OF THE DRAWINGS

FIG. 1 is a conceptual diagram of a system for managing the commuting of small children to and from a primary school.

FIG. 2 is a functional block diagram of a pick-up bus management system.

FIG. 3 is a functional block diagram of a drop-off bus management system.

FIG. 4 is a functional block diagram of a pick-up/drop-off management system.

FIG. 5 is a flowchart of a pick-up bus management method.

FIG. 6 is a flowchart of a drop-off bus management method.

FIG. 7 is a flowchart of a pick-up/drop-off management method.

FIG. 8 is a hardware configuration diagram showing an ID information reading/processing apparatus 200 on a school bus and at the entrance/exit of a school.

FIG. 9 is a hardware configuration diagram showing a processing apparatus in a teacher's office.

FIG. 10 is a drawing showing an example of the data structure for one record of a school commuting management application program in a personal computer in a teacher's office and one record in the master bus and school entrance/exit database.

FIG. 11 is a drawing showing an example of the structure of daily data.

FIG. 12 is a hardware configuration diagram showing an ID information reading/processing apparatus that uses a cellular telephone in place of a wireless apparatus.

FIG. 13 is a hardware configuration diagram showing an ID information reading/processing apparatus that uses a LAN or a LAN cellular telephone in place of a wireless apparatus.

FIG. 14 is a hardware configuration diagram showing an ID information reading/processing apparatus that uses a barcode in place of an RF ID.

FIG. 15 is a hardware configuration diagram showing an ID information reading/processing apparatus in which a modem and operation keys have been incorporated within a control box.

FIG. 16 is a hardware configuration diagram showing an ID information reading/processing apparatus that is a partial modification of the ID information reading/processing apparatus shown in FIG. 8.

DETAILED DESCRIPTION OF THE INVENTION

Embodiments of the present invention are described below in detail, with reference made to the accompanying drawings.

FIG. 1 is a conceptual diagram of a system for managing the commuting of small children 13 to and from a primary school. This system includes a pick-up/drop-off management system by a pick-up/drop-off bus 14. The primary school 10 has on its grounds the main building 16 and the student entrance/exit 17. Although only a single student entrance/exit 17 is shown in FIG. 1, there can be a plurality thereof. The antenna 20 is disposed on the main building 16, and the antennas 21 and 22 are disposed, respectively, on the pick-up/drop-off bus 14 and at the student entrance/exit 17. The antenna 20, the antenna 21, and the antenna 22 can freely perform wireless transmission and reception of data. The small children 13 are met by parents 25 at the student entrance/exit 17 and at the de-boarding location of the pick-up/drop-off bus 14.

FIG. 2 is a functional block diagram of a pick-up bus management system 30. In the description of the pick-up bus management system 30, the specific person, the pick-up bus 31, and the information management location 32 correspond, respectively, to the small child 13, the pick-up/drop-off bus 14, and the main building 16 of FIG. 1. The pick-up bus management system 30 performs processing of ID information storage media that are issued to and can be carried by each specific person, and that have information recorded therein regarding each specific person. The pick-up bus management system 30 has a reading device 35, a mobile communication device 36, a boarding location specific expected-passenger information generating device 39, a boarding location specific boarded-passenger information generating device 40, an expected-passenger identifying device 41, an expected passenger information sending device 42, and an expected-passenger notifying device 44. The reading device 35, the mobile communication device 36, and the expected-passenger notifying device 44 are disposed on the pick-up bus 31, and the boarding location specific boarded-passenger information generating device 40, the expected-passenger identifying device 41, and the expected-passenger information sending device 42 are disposed at the information management location 32. At a boarding location that is the current location of the pick-up bus 31 (hereinafter "current boarding location"), the reading device 35 reads ID information from the ID information storage medium of a specific person who boards at that location. The mobile communication device 36 performs sending the receiving of data with the information management location 32, which is a location other than the current location of the pick-up bus 31, via wireless communication. The boarding location specific expected-passenger information generating device 39 generates boarding location specific expected-passenger information. The boarding location specific boarded-passenger information generating device 40 generates boarded-passenger information for each boarding location separately based on the ID information and the boarding location information received from the pick-up bus 31. The expected-passenger identifying device 41 identifies an expected passenger at the current boarding location, based on a comparison of the boarding location specific expected passenger information and the boarding location specific boarded-passenger information. The expected-passenger information sending device 42 sends to the pick-up bus 31 expected-passenger information related to an identified expected passenger. The expected-passenger notifying device 44 performs notification of an expected passenger at the current point in time at the current boarding location, based on expected-passenger information received from the pick-up bus 31.

The database 47 holds ID information of all specific persons, such as all the children at a primary school, an the boarding location specific expected-passenger information generating device 39 extracts and generates from the database 47 only boarding location specific expected-passenger information for the next pick up by the pick-up bus 31. The notification by the expected-passenger notifying device 44 of a specific person that has not yet boarded is usually made, for example, to the driver of the pick-up bus 31, and this is not restricted to indication on a prescribed display, but can also include notification by sound. The notification typically corresponds to a notification manually made request by the driver of the pick-up bus 31, but even if this is in response to a manual operation by the driver, it is also possible at each of the boarding locations for the reading device 35 to perform automatic notification of expected-passenger information for each new reading of ID information.

In this manner, because an expected passenger at the current boarding location is identified at the pick-up bus 31, it is possible for the driver of the pick-up bus 31 to make an proper judgment as to whether or not it is appropriate to leave the current boarding location, thereby enabling efficient operation of the pick-up bus 31.

What follows is a more specific embodiment of the pick-up bus management system 30. The pick-up bus management system 30 has a further updating device 49 at the information management location 32. The updating device 49 updates the boarding location specific boarded-passenger information based on notification of absentees from a specific person or from a related person. At the information management location 32, a prescribed person in charge accepts an "absent today because of illness," or "late and will ride a later pick-up bus 31" notification or the like from the home of the specific person, via telephone, facsimile, or electronic mail or the like. The receiving person in charge receives this notice, performs input of the fact that the prescribed specific person will not be boarding the pick-up bus 31 this time, and removes that specific person from the expected-passengers. By doing this, the boarding location specific expected-passenger information is the latest information, and the expected-passenger information notified by the expected-passenger notifying device 44 is also the latest information, enabling the driver of the pick-up bus 31 to be relieved of the trouble of unnecessary waiting for an expected passenger.

FIG. 3 is a functional block diagram of a drop-off bus management system 55. In the description of this drop-off bus management system 55, the first and second specific persons correspond, respectively, to the small child 13 and the parent 25 of FIG. 1, and the drop-off bus 56 and the information management location 32 correspond, respectively, to the drop-off bus 14 and the main building 16 of FIG. 1, the drop-off bus management system 55 performs processing of ID information storage media that are issued to and can be carried by the first and second specific persons, and in which is stored ID information regarding the specific persons. The drop-off bus management system 55 has a reading device 58, a boarded-passenger list information generating device 59, a discriminating device 60, and a handover-completed information generating device 61. The reading device 58 reads as boarded-passenger information the ID information of the ID information storage medium of the first specific person when the first specific person boards the drop-off bus 56 at the origin location, and also reads as meeting person information ID information of the ID information storage device of the second person at the de-boarding location, which is the destination of the first specific person. The boarded-passenger list information generating device 59 generates boarded-passenger list information. The discriminating device 60 makes a first and a second judgment, respectively, in the cases in which, based on the meeting-person information and the boarded-passenger list information, the first specific person corresponding to the second specific person has and has not boarded the drop-off bus 56. The handover-completed information generating device 61, in the case in which the first judgment has been made, generates handover-completed information, which indicates that the first specific person has been met by the corresponding second specific person.

The information management location 32 can also serve as the point of origin of the specific person that boards the drop-off bus 56. The boarding location of the specific person that is the point of origin can also be a plurality of locations within the grounds of the information management location 32, rather than a single location. The drop-off bus 56 can have a plurality of de-boarding locations, rather than a single de-boarding location, as the destinations of the specific person. The drop-off bus management system 55 can be applied to the case in which there is a plurality of drop-off buses 56, and to the case in which a single drop-off bus 56 makes a plurality of rounds at different times of the same day. It is possible at the information management location 32 to ascertain whether or not the first specific person brought by the drop-off bus 56 has been picked up by the second specific person as the pick-up person.

A description of more-specific embodiment of the drop-off bus management system 55 follows.

The drop-off bus management system 55 has a notifying device 65. When the second judgment is made, the notifying device 65 makes a notification to that effect. The notification by the notifying device 65 is an indication on a display, or an output of a sound from a speaker. In this manner it is possible for a second specific person that has come to meet someone at a de-boarding location to quickly ascertain whether or not the first specific person that was to be met is riding on the drop-off bus 56.

The information management location 32 exists as a prescribed location, and the drop-off bus 56 has a mobile communication apparatus (not illustrated) for the purpose of sending and receiving data with the information management location 32. For example, the reading device 58 and notifying device 65 are disposed on the drop-off bus 56, and the handover-completed information generating device 61 is disposed at the information management location 32. The boarded-passenger list information generating device 59 and the discriminating device 60 are displayed on the drop-off bus 56 or at the information management location 32. In FIG. 3, the boarded-passenger list information generating device 59 and discriminating device 60 are both disposed on the drop-off bus 56. When a means as a sender of information serving as the basis for processing is located not in the one of the drop-off bus 56 and information management location 32 at which the device 58 to 61 and 65 are disposed, but at the other, the device 58 to 61 and 65 receives information from the other by wireless communication by the mobile communication apparatus.

FIG. 4 is a functional block diagram of a pick-up/drop-off management system 73. In the description of this pick-up/drop-off management system 73, the first and second specific persons correspond, respectively to the small child 13 and the parent 25 in FIG. 1, and the meeting place 74 and the information management location 32 correspond, respectively, to the pick-up/drop-off bus 14 and the main building 16 of FIG. 1. The pick-up/drop-off management system 73 performs processing with regard to performing processing of two ID information storage media, one issued to a first specific person who boards a bus, which stores information regarding that person, and another which is issued to a second specific person coming to meet the first specific person on the bus, which stores information regarding the second specific person meeting the first specific person on the bus. The pick-up/drop-off management system 73 has a reading device 77, a de-boarded passenger list information generating device 77, a discriminating device 79, and a handover-completed information generating device 80. The reading device 77 reads as de-boarded passenger information and meeting-person information, at a prescribed meeting place, the ID information of the ID information storage media of the first and second specific persons. The de-boarded passenger list information generating device 78 generates de-boarded passenger list information, based on the meeting-person information. The discriminating device 79 makes a first and a second judgment, respectively, in the cases in which, based on the meeting-person information and the de-boarded passenger information, the first specific person corresponding to the second specific person is and is not at the meeting location. In the case in which the first judgment is made, the handover-completed information generating device 80 generates handover-completed information associated with the first specific person indicating that the first specific person was handed over to the corresponding second specific person.

There can be a plurality of meeting location 74 with respect to a single information management location 32. In this manner in either case (a), in which, as the de-boarding person the first specific person has the ID information of his or her ID information storage medium read at the meeting location 74 and, after waiting there, is met by a meeting person (second specific person) who arrives there and had the ID information read from his or her ID information storage medium or in case (b), in which the second specific person arrives at the meeting location 74 before the first specific person who is to be met, and has the ID information of his or her ID information storage medium read, detection is made that both the first specific person and the specific person, one of which is being met and the other of which is meeting, are at the meeting location 74, this completing the handover of the first specific person to the specific person. A further detailed embodiment of the pick-up/drop-off management system 73 will now be described.

The pick-up/drop-off management system 73 further has a notification device 83. When the second judgment is made, the notifying device 83 makes notification of information to that effect. By this notification, the specific person can know that the first specific person, whom he or she is coming to meet, is not at the meeting location 74. On the other hand, if the first specific person arrives at the meeting location 74 ahead of the specific person, and has the ID information of his or her ID information storage medium read, notification can be made to the first specific person that the second specific person has not yet arrived at the meeting location 74.

The information management location 32 exists as a prescribed location separate from the meeting location 74. A wireless apparatus (not illustrated) for the purpose of sending and receiving data with the information management location 32 is disposed at the meeting location 74. The reading device 77 and the notifying device 83 are disposed at the meeting location 74, and the handover-completed information generating device 80 is disposed at the information management location 32. The boarded-passenger list information generating device 59 and the discriminating device 79 are disposed either at the meeting location 74 or at the information management location 32. In FIG. 4 both the boarded-passenger list information generating device 59 and the discriminating device 79 are disposed at the meeting location 74. When a means as a sender of information serving as the basis for processing is located not in the one of the meeting location 74 and information management location 32 at which the devices 77 to 80 are disposed, but at the other, the devices 77 to 80 receive information from the other by wireless communication by the mobile communication apparatus.

FIG. 5 is a flowchart of a method for managing a pick-up bus. This pick-up bus management method corresponds to the pick-up bus managing method 30, and performs processing of portable ID information storage media, where are issued to each specific person and which store ID information with regard to that specific person, and corresponds to the pick-up/drop-off bus management system 30 of FIG. 2. This method for managing a pick-up bus has steps S90, S91, and S100 at a pick-up bus 31 and steps S94 through S97 at a information management location 32. First, at the pick-up bus 31, in step S90 at the boarding location of the pick-up bus 31 (hereinafter "current boarding location"), the ID information regarding a boarding person is read from the person's ID information storage medium. At step S91, the read ID information is sent by a mobile wireless communication. Next, at the information management location 32 at step S94 boarding location specific expected-passenger information is generated. At step S95, boarding location specific boarded-passenger information is generated for each boarding location separately, based on the ID information and boarding location information received from the pick-up bus 31. At step S96, passengers expected to board at the current boarding location are identified, based on a comparison of the boarding location specific expected-passenger information and the boarding location specific boarded-passenger information. At step S97, expected-passenger information related to the identified expected passengers is sent to the pick-up bus 31. Then, returning to the pick-up bus 31, at S100 notification is made with regard to persons who are expected to board at the current point in time at the current boarding location, based on the expected-passenger information received from the information management location.

In a more specific embodiment of the pick-up bus management method shown in FIG. 5, there is the addition of step S102 at the pick-up bus 31. At step S102, the boarding location specific expected-passenger information is updated, based on notification of absence received from a specific person or a related person. Because the part of the pick-up bus 31 managing method in steps S94 through S97 is executed, for example, each time new ID information is received from the pick-up bus 31, or each time a given amount of time elapses, after the updating of the boarding location specific boarded-passenger information at step S102, the boarding location specific boarded-passenger information at step S95 is updated, based on the updated boarding location specific boarded-passenger information.

FIG. 6 is a flowchart of a method for managing a drop-off bus. This method corresponds to the drop-off bus management apparatus 55 shown in FIG. 3, and performs processing of ID information storage media that are issued to and can be carried by the first and second specific persons, and in which is stored ID information regarding the specific persons. At step S104, the ID information of the ID information storage medium of the first specific person is read when the first specific person boards the drop-off bus 56 at the origin location, and also the information ID information of the ID information storage device of the second person at the de-boarding location, which is the destination of the first specific person, is read. At step S105, boarded-passenger information is generated as boarded passengers list information. At step S106, a first or a second judgment, respectively, is made, for the cases in which, based on the meeting-person information and the boarded-passenger list information, the first specific person corresponding to the second specific person has and has not boarded the drop-off bus 56. In the case in which the first judgment is made, at step S107 handover-completed information is generated, which indicates that the first specific person has been met by the corresponding second specific person. In the case in which the second judgment is made, notification thereof is made at step 108.

The information management location 32 exists as a prescribed location, steps S104 and S108 are executed at drop-off bus 56, step S107 is executed at the information management location 32, and steps S105 and S106 are executed at the drop-off bus 56 or at the information management location 32. In the flowchart of FIG. 6, both of steps S105 and S106 are executed at the drop-off bus 56. In the case in which a step that sends information serving as the basis for processing is executed not at the location of the execution of steps S105 and S106, which is either the drop-off bus 56 or the information management location 32, but at the other one of the drop-off bus 56 and the information management location 32, reception is done by a mobile communication apparatus provided on the drop-off bus 56 from the other location.

FIG. 7 is the flowchart of a pick-up/drop-off management method. This pick-up/drop-off management method corresponds to the pick-up/drop-off management system 73 of FIG. 4, and performs processing with regard to performs processing of two ID information storage media, one issued to a first specific person who boards a bus, which stores information regarding that person, and another which is issued to a second specific person coming to meet the first specific person on the bus, which stores information regarding the second specific person meeting the first specific person on the bus. At step S118, at a prescribed meeting location 74 ID information is read as de-boarding passenger information and meeting person information, respectively, from the ID information storage media of the first and second specific persons. At step S119 de-boarding passenger information is generated as information of a list of de-boarding passengers, based on the de-boarding passenger information. At step S120, a first and second judgment are made, respectively, for the cases in which, based on the meeting person information and the de-boarding passenger information, the first specific person corresponding to the second specific person is and is not at the meeting location 74. In the case in which the first judgment is made, at step S121, handover-completed information is generated, which is associated with the first specific person, and which indicates that the first specific person has been handed over to the corresponding second specific person. In the case in which the second judgment is made, at step S122 notification is made of information to that effect.

The information management location 32 exists as a prescribed location separate from the meeting location 74. The steps S118 and S121 are executed at the meeting location 74, the step S121 is executed at the information management location 32, and the steps S119 and S120 are executed at either the meeting location 74 or the information management location 32. In the case in which a step that sends information serving as the basis for processing is executed not at the location of the execution of steps S105 and S106, which is either the meeting location 74 or the information management location 32, but at the other one of the meeting location 74 and the information management location 32, reception is done by a mobile communication apparatus provided on the meeting location 74 from the other location.

Specific embodiments of the present invention are described below. Embodiment 1 is an application of the present invention to pick-up and drop-off of primary school students. FIG. 8 is a hardware configuration diagram showing a reading/processing apparatus 200 on a school bus and at the entrance/exit of a school. The reading/processing apparatus 200 has a wireless apparatus having and antenna 201, a model 203, a control box 204, an RF reader 205 having RF ID antenna 206, and a microphone 209. The control box 204 has connected to it operation keys 207 and a display 208. A CPU 2041 and a memory (master data area 2042 and general data area 2043) exist within the control box 204.

FIG. 9 is a hardware configuration diagram showing a processing apparatus 209 in a teacher's office. The teacher's office processing apparatus 209 has a wireless apparatus having an antenna 210, a modem 212, a control box 213, a personal computer 214, and a microphone 215. A CPU 213 exists within the control box 213.

In addition, students and parents have RF ID tags. The RF ID reader 205 is an apparatus that reads a tag number of an RF ID tag that is held up to the antenna 206 of the RF ID reader. The control boxes 204 and 213 encode tag number data read by the RF ID reader 205 and data input from the personal computer 214, and send the results to the modems 203 and 212. Alternatively, in the reverse direction they decode data output from the modems 203 and 212 and display the data on the display 208 or output the data to the personal computer 214. The master data area 2042 within the control box 204 has stored in it beforehand the names, tag numbers, and parent tag numbers, and other tagged student information (master data) for each individual student.

The modems 203 and 212 input from the control boxes 204 and 213 ID numbers read from the RF ID reader 205 and data from the personal computer 214, convert this data to analog signals and output it to the wireless apparatuses 202 and 211. Alternatively in the reverse direction, they input analog signals from the wireless apparatuses 202 and 211, convert this to data, and output it to the control boxes 204 and 213.

The wireless apparatuses 202 and 211 modulate the analog signals input from the modems 203 and 212 and transmit these from the antennas 201 and 210. In the reverse direction, they demodulate the radio signals received by the antennas 201 and 210, and output analog signals to the modems 203 and 212.

It is possible in addition to data communication, to use general wireless voice communication, using the microphones 209 and 215. A school-departure management application program is installed in the personal computer 214. This program serves the function of receiving the fact that a student has boarded or de-boarded from a bus, or that the student is at the school entrance/exit and storing this into the daily data 2142. A copy of contents of the master data 2141 are copied upon each day of operation and serve as the daily data 2142. FIG. 10(*a*) is a drawing showing the data structure for one record (of the master data 2141) of a school commuting management application program in a personal computer in a teacher's office, and FIG. 11 is a drawing showing an example of the structure of daily data. The daily data 2142 can be made to reflect singular events such as the day-to-day temporary changes, for example absences and changes of the station used when going home from school. In actual operation, for example, this data is used to record things such as "absent" and "proof of having been met" in the case of a bus, or "arrival at school," "departed from school," and "proof having been met" in the case of a school entrance/exit.

The master data region 2042 has therein a copy of the minimum required items required on a bus and at a school entrance/exit (data related to student names, RF ID tag numbers, and parent RF ID tag numbers and the like) from the master data that is generated within the school departure management application program executed by the personal computer 214 in the teacher's office. FIG. 10(*b*) shows an example of the structure of one record within the master data region 2042 of a bus or school entrance/exit.

The basic operation at the time of commuting to school is as follows.

When students either board a school bus or pass through the school entrance/exit in the case of students walking to school, each student holds his or her RF ID tag up to the antenna 206 of the RF ID reader 205. The CPU 2041 within the control box 204 acquires the RF ID tag number of the student from the RF ID reader 205, and searches to determine whether or not this tag number exists within the master data 2042. In the case in which it exists within the master data 2042, the information for that student (minimally the student's RF ID tag number and parent's RF ID tag number) is recorded as part of a boarding list in the general data region 2043.

Once the boarding of students has been completed, the CPU 2041 in the control box 204 performs encoding of the student RF ID tag numbers in the boarding list, and then outputs them to the modem 203. The modem 203 then converts this to a modulated signal, using AFSK modulation or the like, passes the resulting analog signal to the wireless apparatus 202, simultaneously sets the wireless apparatus into the transmitting condition, and transmits this from the antenna 201. At the teacher's office, the radio signal received from the antenna 210 is demodulated by the wireless apparatus 211, the resulting signal being received by the modem 212, which performs conversion to tag number data, whereupon the control box 213 demodulates this encoded data and passes it the personal computer 214, at which an application program performs management and storage of this tag number into the daily data 2142.

A check of yet-to-board passengers at the time of commuting to school is performed as follows.

At the time of commuting to school, the school bus goes to a station to meet and take student aboard, and it is necessary to make a judgment of whether it is appropriate to return to the school, that is, to ascertain whether or not there are any students who have not yet boarded. This procedure is performed as follows. A "Not-yet-boarded Inquiry" button on is pressed of the operation keys 207 connected to the control box 204. The CPU 2041 sends to the modem 203 a not-yet-boarded verification request command, which includes the name of the station at which it is currently located, the command being sent to the teacher's office, via the wireless apparatus 202 and the antenna 201. At the teacher's office, an analog modulated signal received from the wireless apparatus 211 passes via the model 212, and a not-yet-boarded verification request command is sent by the CPU 2131 of the control box 213 to the personal computer 214. At the personal computer side, based on the station name that is included in the not-yet-boarded verification request command, a check is made from the daily data 2142 to ascertain the boarding status of students for whom there is coincidence of the station name. A list is made of RF ID tag numbers of students who have not yet boarded, these RF ID tag numbers are encoded and passed to the modem 212, whereupon they are sent to the school bus via the wireless apparatus 211 and the antenna 210. At the school bus, the not-yet-boarded list response from the teacher's office to the not-yet-boarded verification command is received by the CPU 2041 of the control box 204, via the antenna 201 and the wireless apparatus 202 and modem 203, and the encoded RF ID tag numbers are decoded. A search is made in the master data region 2042 for the RF ID tag numbers of not-yet-boarded students, and the names of corresponding students are indicated on the display 208, so as to give notification to the driver that not all students have boarded. In the case in which the list of not-yet-boarded students is empty, since this means that all students have boarded, a message such as "All students aboard" is indicated on the display 208, thereby giving notification that it is alright to depart for the school.

The basic operation at the time students depart school is as follows.

The basic operating procedure when students board the school bus is almost the same as when students go to school, the only difference being that evidence is left that a parent meeting a student has received the student. The tag number that is recognized when a student boards is used as a record of boarding, and the control box 204 records this into its internal general data region 2043. The minimum contents recorded at that time are the RF ID tag number of the student and the RF ID tag number of that student's parent, from the master data 2042.

When the school bus reaches a station, a meeting parent holds his or her RF ID tag up to an RF ID reader 205, which is installed in the bus. When this is done, the CPU 2041 of the control box 204 recognizes the tag number of the parent, and searches the parent IDs in the general data region 2043 to see if the parent IDs recorded when students boarded includes the parent of the student who has boarded. If the result of the search is that there was a coincidence, the RF ID tag number of the meeting parent is encoded by the CPU 2041 of the control box 204, after which it is sent, via the modem 203 and the wireless apparatus 202, so as to be transmitted to the teacher's office as a radio signal from the antenna 201. If there was no coincidence, since the student had not boarded, a message such as "Your child is not aboard this bus" or the like is indicated on the display 208, so that, for example, the parent can be made to wait for the next bus.

In the case of a student who does not use the school bus, the student first holds his or her RF ID tag up to the antenna 206 of the RF ID reader 205, after which the parent holds up his or her RF ID tag. After that, the processing is the same as the above-noted school bus procedure.

At the teacher's office, the radio signal received from the antenna 201 is demodulated by the wireless apparatus 211 and then received by the modem 212 so as to convert it to character data for the tag number and pass it to the control box 213. The CPU 2131 of the control box 213 decodes the encoded data, passing it to the personal computer 214, at which an application on the personal computer manages and stores this tag number as a record of leaving school.

In both the case of going to school and the case of leaving school, in the case in which a student or parent has forgotten his or her RF ID card, the operation keys 207 are operated so as to cause display of the name of the student on the display 208 of the control box 204, and boarding or acceptance are performed instead by key input.

The benefits of the first embodiment are as follows.

(a) Simplified control of the return of students from school.

(b) It is possible to record evidence that a student was handed over to a parent when the student left school.

(c) The use of wireless apparatuses enables installation on board a mobile platform and reduces the communication cost.

(d) The use of wireless apparatuses enables a one-to-many broadcast from the teacher's office to all buses.

(e) Compared with the method of checking using a printed list of names, it is possible to reduce labor costs and reduce errors.

In the first embodiment, although the required items were extracted from the master data 214 of the personal computer 214 as the master data region, if there is sufficient extra memory in the control box 204, it is also possible to have the same memory as the master data 2141 of the personal computer 214. Additionally, while the master data is given to both the control box 214 and the control box 214, in the case of using high-speed wireless data communication, it is possible to give this to the personal computer 214 only, and to make a request of the personal computer in the teacher's office when doing a search of a RF ID tag number on a bus or at an entrance/exit, and return the result.

FIG. 12 is a hardware configuration diagram of an ID information reading/processing apparatus 220, the second embodiment of the present invention, which uses a cellular telephone in place of a wireless apparatus. The ID information reading/processing apparatus 220, in place of the wireless apparatus 202, has a cellular telephone 221. Additionally, in the ID information reading/processing apparatus 220, it is not possible to make a general voice broadcast.

FIG. 13 is a hardware configuration diagram of an ID information reading/processing apparatus 230, the third embodiment of the present invention, which uses a LAN or wireless LAN in place of a wireless apparatus. The ID information reading/processing apparatus 230 has a wireless LAN 231.

FIG. 14 is a hardware configuration diagram of an ID information reading/processing apparatus 240, the fourth embodiment of the present invention, which uses a barcode in place of an RF ID. The barcode is not restricted to one-dimensional barcodes, and can alternatively be a two-dimensional barcode. The ID information reading/processing apparatus 240, in place of the RF ID reader 205 of the ID information reading/processing apparatus 200, has a barcode reader 241. Each specific person carries a card or the like, onto which is marked a barcode, and passes this card over the barcode reader 241, so as to have the ID information associated with the barcode read. Additionally, in place of the barcode it is possible to use a contact-type IC card or magnetic card, in which case a reader for a contact-type IC card or for a magnetic card is used in place of the barcode reader 241.

FIG. 15 is a hardware configuration diagram of an ID information reading/processing apparatus 250, the fifth embodiment of the present invention, in which the modem 203 and the operation keys 207 are incorporated within the control box 204. The RF ID reader 205, the RF ID reader antenna 206, the modem 203, the control box 204, and the wireless apparatus 202 can be in separate enclosures, and these elements can be housed in one or two enclosures. In the ID information reading/processing apparatus 250 shown in FIG. 15, the modem 203 and the operation keys 207 are brought together within the enclosure of the control box 204.

FIG. 16 is a hardware configuration diagram of an ID information reading/processing apparatus 260, the sixth embodiment of the present invention, which is a partial modification of the ID information reading/processing apparatus 200 shown in FIG. 8. To the ID information reading/processing apparatus 200 is added an electronic lock 261 at a school entrance/exit or the like, at which a parent would meet his or her child. When a judgment is made, based on ID information read from the RF ID tags of a small child, who is waiting at a school entrance/exit and a parent who comes to meet the child, that both the child and the meeting parent are present at the entrance/exit meeting place, the electronic lock 261 goes into the opened state, so that the school entrance/exit opens, allowing the parent to receive his or her child from the school entrance/exit.

The invention claimed is:

1. A pick-up bus management system, comprising:

at a pick-up bus, means for reading ID information from an ID information storage medium associated with a specific person boarding at a boarding location, which is a current location of the bus;

means for mobile communication, which sends and receives data via wireless communication with a prescribed information management location;

at a prescribed information management location, a boarding location specific expected-passenger information generating means, which generates boarding location specific expected-passenger information;

boarding location specific boarded-passenger information generating means, which generates boarding location boarded-passenger information, based on ID information and boarding location information received from a bus;

not-yet-boarded identifying means, which identifies a not-yet-boarded passenger at a current boarding location, based on a comparison of the boarding location specific expected-passenger information and the boarding location specific boarded-passenger information;

not-yet-boarded passenger information sending means, which sends to the bus expected-passenger information regarding an identified not-yet-boarded passenger; and at the pick-up bus, a not-yet-boarded passenger notification means, which makes notification of a not-yet-boarded passenger at a current point in time at the current boarding location, based on the not-yet-boarded passenger information received from the information management location.

2. A pick-up bus management system as recited in claim 1, further comprising, at the information management location, means for updating the boarding location specific expected-passenger information, based on notification of absence from a specific person or a person related thereto.

3. A drop-off bus management system, comprising:

means for reading, which reads as boarded-passenger information an ID information of ID information storage medium of the first specific person when a first specific person boards a drop-off bus at an origin location, and also reads as meeting person information ID information of an ID information storage means of a second person at a de-boarding location, which is a destination of the first specific person;

a boarded-passenger list information generating means, which generates boarded-passenger list information, based on boarded-passenger information;

a discriminating means, which makes a first and a second judgment in cases, respectively, in which, based on the meeting person information and boarded passenger information, the first specific person corresponding to the second specific person has and has not boarded the drop-off bus; and a handover-completed information generating means, which generates handover-completed information associated the first specific person, which indicates that the first specific person has been handed over to a corresponding second specific person.

4. A drop-off bus management system as recited in claim 3, further comprising means for notification, which notifies of information regarding making the second judgment.

5. A drop-off bus management system as recited in claim 4, wherein:

the information management location exists as a prescribed location;

the drop-off bus comprises a mobile communication apparatus for transmitting and receiving data with the information management location;

the reading means and the notifying means are disposed at the drop-off bus;

the handover-completed information generating means is disposed at the information management location;

the boarded-passenger list information generating means and discriminating means are disposed at either the drop-off bus or the information management location; and wherein when a means as a sender of information serving as a basis for processing is located not at one of the drop-off bus and information management location at which the means are disposed, but at the other, the means receives information from the other by wireless communication by the mobile communication apparatus.

6. A pick-up/drop-off management system, comprising:

a reading means, which reads, from an ID information storage media of a first and a second specific person, de-boarding passenger information and meeting person information;

a de-boarding passenger list information generating means, which generates de-boarding passenger list information, based on de-boarding passenger information;

a discriminating means, which makes a first and a second judgment, respectively, in a case in which, based on the meeting person information and the de-boarded passenger information, a first specific person corresponding to a second specific person is and is not at a meeting location; and a handover-completed information generating means, which generates handover-completed information associated with the first specific person indicating that the first specific person was handed over to the corresponding second specific person.

7. A pick-up/drop-off management system as recited in claim 6, further comprising means for notification, which notifies of information regarding making of the second judgment.

8. A pick-up/drop-off management system as recited in claim 7, wherein:

the information management location exists as a prescribed location separate from the meeting location;

the meeting location has a mobile communication apparatus for transmitting and receiving data with the information management location;

the reading means and the notifying means are disposed at the meeting location;

the handover-completed information generating means is disposed at the information management location;

the boarded-passenger list information generating means and discriminating means are disposed at either the meeting location or the information management location; and wherein when a means as a sender of information serving as a basis for processing is located not at one of the meeting location and information management location at which the means are disposed, but at the other, the means receives information from the other by wireless communication by the mobile communication apparatus.

9. A method for managing a pick-up bus, comprising:

at a bus, a step of reading, from an ID information storage medium, ID information related to a specific passenger who boards the bus at a boarding point of the pick-up bus, which is the current location of a pick-up bus;

a step of sending the read ID information by mobile wireless communication;

at a prescribed information management location, a step of generating expected-passenger information separately for each boarding location;

a step of generating, as specific person information for a persons who have boarded, already-boarded specific person information for each boarding location; based on ID information and boarding location information received from the pickup bus;

a step of identifying a specific person who has not yet boarded at the current location, based on a comparison of the boarding location specific expected-passenger information for each boarding location and the already-boarded specific person information for each boarding location;

a step of sending to the pick-up bus information regarding a specific person identified as having not yet boarded; and at the pick-up bus, a step of giving notification of a person who has not yet boarded at the current location, based on the information regarding a specific person who has not boarded received from the information management location.

10. A method for managing a pick-up bus as recited in claim 9, further comprising at the information management location a step of updating the boarding location specific expected-passenger information, based on notice of absence from the specific person or a person related thereto.

11. A method for managing a drop-off bus, comprising:

a step of reading, as boarded-passenger information, ID information of an ID information storage medium of a first specific person when the first specific person boards a drop-off bus at an origin point, and of reading, as meeting person information, ID information of an ID information storage medium of a second specific person at a de-boarding location, which is a destination of the first specific person;

a step of generating boarded passenger list information of persons who have boarded;

a step of discriminating, whereby a first and a second judgment are made in respective cases in which, based on the meeting person information and boarding passenger information, the first specific person corresponding to the second specific person is and is not riding on the drop-off bus; and a step of generating handover-completed information associated with the first specific person, which indicates that the first specific person has been handed over to the corresponding second specific person.

12. A method for managing a drop-off bus as recited in claim 11, further comprising a step of, when the second judgment is made, making notification of information regarding the making of the second judgment.

13. A method for managing a drop-off bus as recited in claim 12, wherein:

the information management location exists as a prescribed location, the reading step and the notifying step are executed at the drop-off bus, the handover-completed information generating step is executed at the information management location, the boarded-passenger list information generating step and discriminating step are executed at either the drop-off bus or the information management location, and wherein when a step of sending information serving as a basis for processing is located not at one of the drop-off bus and information management location at which the step is executed, but at the other, reception of done via a wireless apparatus by wireless communication by a mobile communication apparatus on the drop-off bus.

14. A method for managing pick-up/drop-off, comprising:

a step of reading, at a prescribed meeting location, from a portable ID information storage media of a first and a second specific person, ID information of the first specific person, who will de-board a bus, and ID information of the second specific person, who will meet the first specific person;

a step of generating de-boarding passenger list information regarding passengers who de-board, based on de-boarded passenger information;

a step of discriminating, whereby a first and a second judgment are made in respective cases in which, based on meeting person information and de-boarding passenger information, the first specific person corresponding to the second specific person is and is not present at the meeting location; and a step of generating handover-completed information associated with the first specific person indicating that the first specific person has been handed over to the corresponding second specific person.

15. A method for managing pick-up/drop-off as recited in claim 14, further comprising a step of, when the second judgment is made, making notification of information regarding the making of the second judgment.

16. A method for managing pick-up/drop-off as recited in claim 15, wherein:

the information management location exists as a prescribed location separate from the meeting location;

the reading step and the notifying step are executed at the meeting location;

the handover-completed information generating step is executed at the information management location;

the boarded-passenger list information generating step and discriminating step are executed at either the meeting location or the information management location; and wherein when a step of sending information serving as a basis for processing is located not at one of the meeting location and information management location at which the step is executed, but at the other, reception of done via a wireless apparatus by wireless communication by a mobile communication apparatus at the meeting location.

17. A pick-up bus management system, comprising:

at a pick-up bus, an ID information reader for reading ID information from an ID information storage medium associated with a specific person boarding at a boarding location, which is a current location of a bus;

a mobile communication apparatus, which sends and receives data via wireless communication with a prescribed information management location;

at a prescribed information management location, a boarding location specific expected-passenger information generator, which generates boarding location specific expected-passenger information;

a boarding location specific boarded-passenger information generator, which generates boarding location boarded-passenger information, based on ID information and boarding location information received from the bus;

a not-yet-boarded identifier, which identifies a not-yet-boarded passenger at a current boarding location, based on a comparison of the boarding location specific expected-passenger information and the boarding location specific boarded-passenger information;

a not-yet-boarded passenger information sending apparatus, which sends to the bus not-yet-boarded passenger information regarding an identified not-yet-boarded passenger; and at the pick-up bus, a not-yet-boarded passenger notifying apparatus, which makes notification of a not-yet-boarded passenger at a current point in time at a current boarding location, based on the a not-yet-boarded passenger information received from the information management location.

18. A pick-up bus management system as recited in claim 17, further comprising, at the information management location, an updating apparatus, which updates the boarding location specific expected-passenger information, based on notification of absence from a specific person or a person related thereto.

19. A drop-off bus management system, comprising:

a reader, which reads as boarded-passenger information ID information of an ID information storage medium of a first specific person when the first specific person boards a drop-off bus at an origin location, and also reads as meeting person information ID information of the ID information storage means of a second person at a de-boarding location, which is a destination of the first specific person;

a boarded-passenger list information generator, which generates boarded-passenger list information, based on boarded-passenger information;

a discriminator, which makes a first and a second judgment in cases, respectively, in which, based on the meeting person information and boarded passenger information, the first specific person corresponding to the second specific person has and has not boarded the drop-off bus; and a handover-completed information generator, which generates handover completed information associated the first specific person, which indicates that the first specific person has been handed over to a corresponding second specific person.

20. A drop-off bus management system as recited in claim 19, further comprising a notifying apparatus, which notifies of information regarding the making of the second judgment.

21. A drop-off bus management system as recited in claim 20, wherein:

the information management location exists as a prescribed location;

the drop-off bus comprises a mobile communication apparatus for transmitting and receiving data with the information management location;

the reader and the notifying apparatus are disposed at the drop-off bus;

the handover-completed information generator is disposed at the information management location;

the boarded-passenger list information generator and discriminator are disposed at either the drop-off bus or the information management location; and wherein when a sending apparatus that sends of information serving as a basis for processing is located not at one of the drop-off bus and information management location at which the apparatus are disposed, but at the other, the apparatus receives information from the other by wireless communication by the mobile communication apparatus.

22. A pick-up/drop-off management system, comprising:

a reader, which reads, from an ID information storage media of a first and a second specific person, de-boarding passenger information and meeting person information;

a de-boarding passenger list information generator, which generates deboarding passenger list information, based on de-boarding passenger information;

a discriminator, which makes a first and a second judgment, respectively, in a case in which, based on the meeting information and the de-boarded passenger information, the first specific person corresponding to the second specific person is and is not at the meeting location; and a handover-completed information generator, which generates handover completed information associated with the first specific person indicating that the first specific person was handed over to the corresponding second specific person.

23. A pick-up/drop-off management system as recited in claim 22, further comprising a notifying apparatus, which notifies of information regarding the making of the second judgment.

24. A pick-up/drop-off management system as recited in claim 23, wherein:

the information management location exists as a prescribed location separate from the meeting location;

the meeting location has a mobile communication apparatus for transmitting and receiving data with the information management location;

the reader and the notifying are disposed at the meeting location;

the handover-completed information generator is disposed at the information management location;

the boarded-passenger list information generator and discriminator are disposed at either the meeting location or the information management location; and wherein when an apparatus that sends information serving as a basis for processing is located not at one of the meeting location and information management location at which the apparatus is disposed, but at the other, the apparatus receives information from the other by wireless communication by the mobile communication apparatus.

* * * * *